US006322420B1

(12) United States Patent
Daniellian

(10) Patent No.: US 6,322,420 B1
(45) Date of Patent: Nov. 27, 2001

(54) PLUSH TOY HAVING EAR AND FOOT MOVEMENT

(75) Inventor: Armen Daniellian, Woodland Hills, CA (US)

(73) Assignee: Mattel Inc., El Segundo ( * ) Notice: Subject to any disclaimer, the term of this patent is extended or adjusted under 35 U.S.C. 154(b) by 0 days.

(21) Appl. No.: 09/497,604

(22) Filed: Feb. 3, 2000

(51) Int. Cl.[7] ..... A63H 13/00
(52) U.S. Cl. ..... 446/300; 446/353; 446/390
(58) Field of Search ..... 446/297, 298, 446/300, 303, 330, 337, 353, 370, 371, 376, 390

(56) References Cited

U.S. PATENT DOCUMENTS

| | | | | |
|---|---|---|---|---|
| 4,237,647 | | 12/1980 | Shaw . | |
| 4,516,951 | * | 5/1985 | Saigo et al. | 446/353 X |
| 4,696,653 | | 9/1987 | McKeefery | 446/175 |
| 4,820,236 | | 4/1989 | Berliner et al. | 446/369 |
| 4,867,726 | | 9/1989 | Fujimaki | 446/175 |
| 4,878,871 | | 11/1989 | Noto | 446/302 |
| 4,923,428 | | 5/1990 | Curran | 446/175 |
| 5,011,449 | | 4/1991 | Handy et al. | 446/297 |
| 5,141,464 | | 8/1992 | Stern et al. | 446/338 |
| 5,267,886 | | 12/1993 | Wood et al. | 446/175 |
| 5,279,514 | | 1/1994 | Lacombe et al. | 446/297 |
| 5,304,087 | * | 4/1994 | Terzian et al. | 446/337 X |
| 5,324,225 | | 6/1994 | Satoh et al. | 446/175 |
| 5,489,231 | | 2/1996 | Leyser | 446/302 |
| 5,735,726 | | 4/1998 | Cohen | 446/288 |

FOREIGN PATENT DOCUMENTS

| | | | | |
|---|---|---|---|---|
| 263446 | * | 12/1926 | (GB) | 446/353 |

* cited by examiner

*Primary Examiner*—John A. Ricci
(74) *Attorney, Agent, or Firm*—Roy A. Ekstrand

(57) ABSTRACT

A plush toy figure includes a motor-driven apparatus supported within the figure head for wiggling a pair of ear paddles which in turn causes the figure's ears to wiggle. A second motor drive unit supported within the figure's torso is operatively coupled to a pair of toe paddles which are oscillated to cause the figure's toes to wiggle. The figure's legs are pivotable between a standing and sitting position and the toes are operative in either posture. A switch positioned within the figure's mouth is actuated by the pressure of an item pressed against the figure's mouth to actuate the upper and lower drive mechanisms thereby causing the ears and toes to wiggle. The supporting paddles of the ears and toes include a spring-biased hinge to prevent damage to the drive mechanism due to misuse or excessive force applied to the ears or toes.

7 Claims, 4 Drawing Sheets

10
11
12
13
14
15
16
17
18
19
21
22
23
24
30
31
33
34
35
36
41
43
44
45
46
50
51
52
53
54
58
60
61
62
63
64
65
66
67
68
69
70
71
72
73
74
75
76
77
78
79
80
81
83
85
86
87
88
89
90
91
92
93
94
95
96
98
100
101
102
103
104
106
108

PLUSH TOY HAVING EAR AND FOOT MOVEMENT

FIELD OF THE INVENTION

This invention relates generally to plush toys and particularly to those utilizing movement features to enhance play value.

BACKGROUND OF THE INVENTION

Plush toys have been a well known and popular type of doll and toy figure for many years. Such plush toys vary in appearance, however, all generally include a body formed of a soft resilient padded material upon which an outer skin or covering has been applied. Such plush toys have, for example, been provided in human-like appearances as well as animal-like appearances and fanciful cartoon like characters or the like. Not surprisingly, practitioners in the art have endeavored through a great variety of features to enhance the play value and amusement value of plush toys. While substantial effort has been directed to the external appearance of such plush toys to make them more interesting and attractive, other enhancements have been more substantial and have involved features of the toy itself. One popular enhancement which has enjoyed long term success is the introduction and addition of sound-producing mechanisms within the plush toy. Early sound-producing mechanisms were largely mechanical, often resembling simplified miniaturized phonograph players. Subsequently developed sound-producing systems exhibited greater sophistication utilizing recently developed electronic sound-producing circuits. Another enhancement often provided to improve plush toy appeal has been the inclusion of movement apparatus. Typically, such movement apparatus involved the use of relatively rigid skeletal members within the plush figure coupled to some source of power. While many such plush toys utilize spring-powered wind-up sources of power, most modern plush toys employ a battery-powered electric motor combination to move skeletal component within the soft plush body.

Unfortunately, while such features have improved and enhanced the appeal of plush toys, they are often subject to limitations in performance. One limitation which has arisen is the tendency for movement mechanisms to restrict or limit the posture changing capability of the toy. In addition, the movement mechanisms utilized in plush toys have often exhibited a fragile character and are easily broken when handled roughly or mishandled by child users. For example, U.S. Pat. No. 5,279,514 issued to Lacombe, et al. sets forth a GIFT WITH PERSONALIZED AUDIO MESSAGE formed of a stuffed teddy bear housing a control system which enables the playing of a prerecorded message. A microphone is coupled to the main control system and provides a recording as well as play feature for the toy. A plurality of switches are supported within the toy body which actuate the control mechanism when squeezed by the user.

U.S. Pat. No. 4,237,647 issued to Shaw sets forth a SOFT TOY CONTAINING SOUNDING DEVICE which may, for example, resemble an animal such as a teddy bear or the like and which includes a plurality of electric contacts disposed in spaced apart regions of the toy exterior. An electrically operated device for producing a sound is supported within the toy and operatively coupled to the contact pairs. The contact pairs when touched by the user enable the sound-producing apparatus.

U.S. Pat. No. 4,820,236 issued to Berliner, et al. sets forth a DOLL WITH SENSING SWITCH having a soft plush body within which a flexible sensor is captured. Pressure applied to the soft body actuates the flexible sensor and enables a responsive device within the toy body to respond.

U.S. Pat. No. 4,867,726 issued to Fujimaki sets forth ANIMAL TOYS capable of electrically producing sound and/or body movements. The toys are switched on and off by a pair of spaced apart electrical contacts disposed on a body surface of the toy.

U.S. Pat. No. 5,011,449 issued to Handy, et al. sets forth an APPENDAGE MOTION RESPONSIVE DOLL having a body including a torso within which a sound-producing apparatus is supported. An arm appendage supports an elongated flexible bend sensor which is operatively coupled to the sound-producing unit and which activates the sound-producing unit when the arm appendage is stressed.

U.S. Pat. No. 5,141,464 issued to Stern, et al. sets forth a TOUCH-RESPONSIVE ANIMATED TOY FIGURE having a rigid internal skeleton supporting a head and mouth upon which a padded plush body is secured. A motor drive mechanism articulates the head and mouth of the toy. A touch-responsive switch is positioned in the body of the animal figure and actuates the motor mechanism when touched by the user.

U.S. Pat. No. 5,267,886 issued to Wood, et al. sets forth a MULTIPLE ACTION PLUSH TOY having a four-legged plush toy body within which a sound-producing apparatus is disposed. A light producing mechanism is supported within one of the front appendages of the toy body and is actuated by squeezing the appendage.

U.S. Pat. No. 4,489,231 issued to Leyser sets forth a TACTILE AUDIO STUFFED ANIMAL FIGURINE resembling a teddy bear within which an audio recorder and player is supported. The device includes a plurality of different materials with each material corresponding to a particular portion of the body to allow dressing and undressing of the figure for learning purposes.

U.S. Pat. No. 5,735,726 issued to Cohen sets forth an ANIMATED SITTING AND STANDING SANTA CHARACTER having a base supporting a chair upon which a movable figure resembling Santa Claus is supported. The figure is provided with an operative mechanism which facilitates sitting or standing by the Santa figure.

U.S. Pat. No. 4,878,871 issued to Noto sets forth a TOY FOR CONVEYING PERSONALIZED MESSAGE between a sender and a recipient. The toy includes a plush body within which a battery-powered cassette recorder and player is supported. The sender records a personalized message and thereafter transfers the toy to the recipient who then plays the recorded message.

U.S. Pat. No. 4,923,428 issued to Curran sets forth an INTERACTIVE TALKING TOY having a doll body within which a sound recording and play mechanism is operated. The recording mechanism includes a plurality of predetermined responses which are utilized by the sound system to simulate a responsive interactive conversation within the child user.

U.S. Pat. No. 4,696,653 issued to McKeefery sets forth a SPEAKING TOY DOLL which responds with spoken words and/or sentences to the touching of selected portions of the doll by the child user.

U.S. Pat. No. 5,324,225 issued to Satoh, et al. sets forth an INTERACTIVE TOY FIGURE WITH SOUND-ACTIVATED AND PRESSURE-ACTIVATED SWITCHES having a body generally resembling a kitten within which a movement mechanism operates the kitten's tail in response to sound or pressure upon the kitten's body.

While the foregoing described prior art devices have to some extent improved the art and in some instances enjoyed commercial success, there remains nonetheless a continuing need in the art for evermore improved, interesting and amusing plush toys.

SUMMARY OF THE INVENTION

Accordingly, it is a general object of the present invention to provided an improved plush toy. It is a more particular object of the present invention to provide a plush toy having ear and foot movement which resists damage when mishandled or handled roughly. It is a still more particular object of the present invention to provide a damage-resistant plush toy having ear and foot movement which tolerates changes of the plush toy posture.

In accordance with the present invention, there is provided a plush toy comprising: a plush toy body having torso, head, mouth, ears, arms, legs and feet, a pressure responsive switch in the nose; a sound circuit in the torso; a motor controller supported within the torso; a pair of toe movement mechanisms in the legs, feet and toes; a pair of ear movement mechanisms in the ears and head; a first motor in the head coupled to the pair of ear movement mechanisms operative to wiggle the ears; and a second motor in the torso coupled to the pair of toe movement mechanisms operative to wiggle the toes, the motor controller being activated by the pressure responsive switch to activate the first and second motors and the sound circuit.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
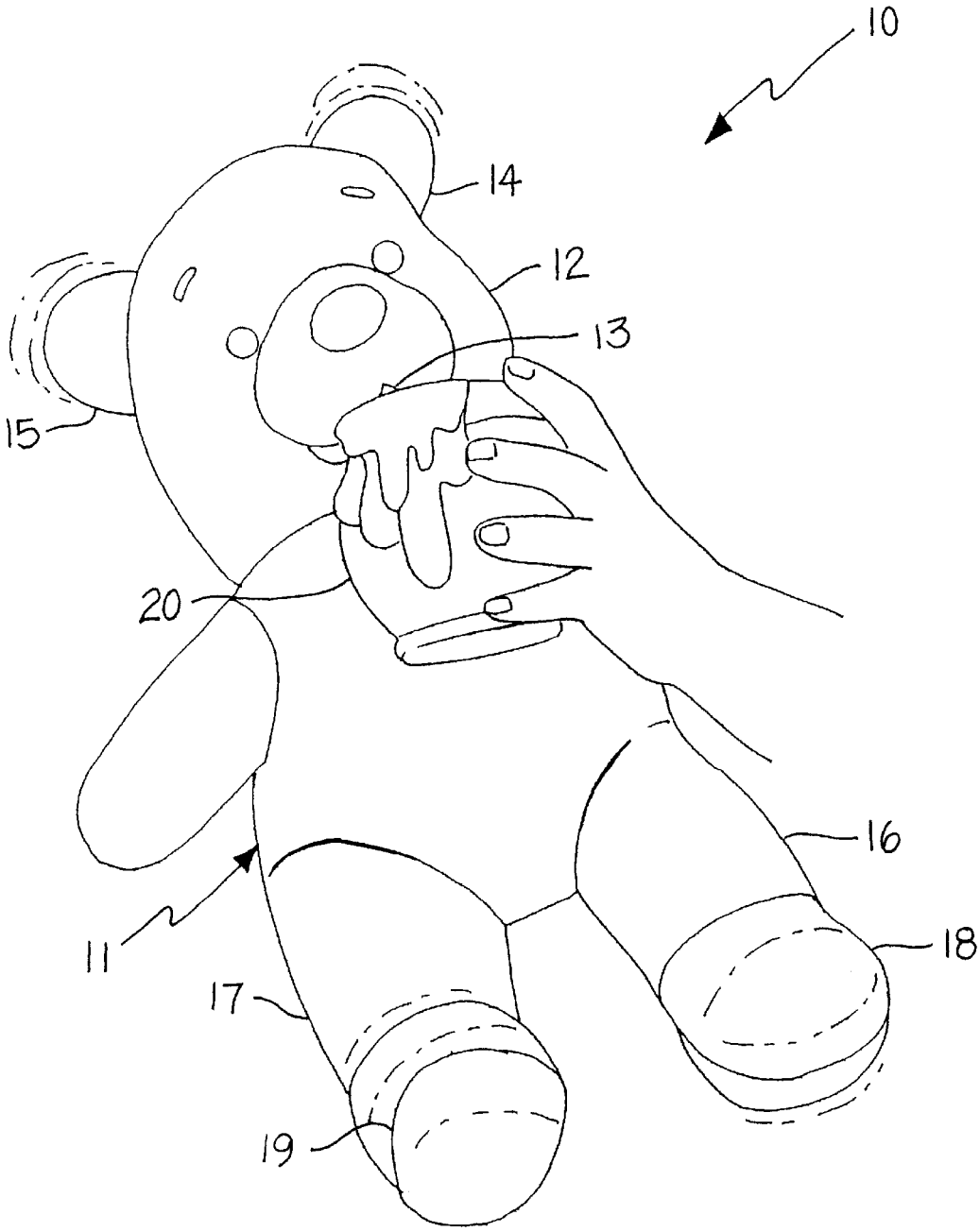
FIG. 1 sets forth a front perspective view of a plush toy constructed in accordance with the present invention in a typical play pattern.

FIG. 1 sets forth a front perspective view of a plush toy constructed in accordance with the present invention and generally referenced by numeral 10. Toy 10 includes a plush body 11 having a head 12 supporting a mouth 13 and a pair of ears 14 and 15. Body 11 further includes a pair of legs 16 and 17 supporting respective toes 18 and 19. In accordance with the anticipated play pattern of the present invention, a cup 20 is held by a child user in a typical play fashion and, in accordance with the present invention, is pressed against mouth 13 of toy 10. By means set forth below in greater detail, the pressure of cup 20 against mouth 13 causes the internal operative mechanism of the present invention toy to wiggle ears 14 and 15 and to wiggle toes 18 and 19.

As is set forth below in FIG. 3 in greater detail and in accordance with an important aspect of the present invention, legs 16 and 17 are pivotable with respect to the remainder of plush body 11 to allow toy 10 to assume a seated or sitting position. In further accordance with the present invention and by the mechanism set forth below in greater detail, the reposturing of toy 10 does not diminish the operative capability by which toes 18 and 19 are wiggled. Plush body 11 may, but for the operative mechanism set forth below in accordance invention, be fabricated generally in accordance with conventional plush fabrication techniques. Thus, for example, plush body 11 may provide a soft padded body surrounding the operative mechanism therein which in turn is covered with an outer flexible and preferably soft to the touch fabric such as cloth or synthetic fur or the like. In accordance with an important aspect of the present invention, the operative mechanism by which ears 14 and 15 and by which toes 18 and 19 are wiggled is protected against rough treatment or even misuse by a novel spring support mechanism allowing ears 14 and 15 and toes 18 and 19 to "yield" when subjected to excessive stress or forces. Thus, plush toy 10 provides an amusing action in wiggling ears and toes while exhibiting a flexibility to permit sitting or standing postures and while enduring rough treatment or even misuse.

Figure 2:
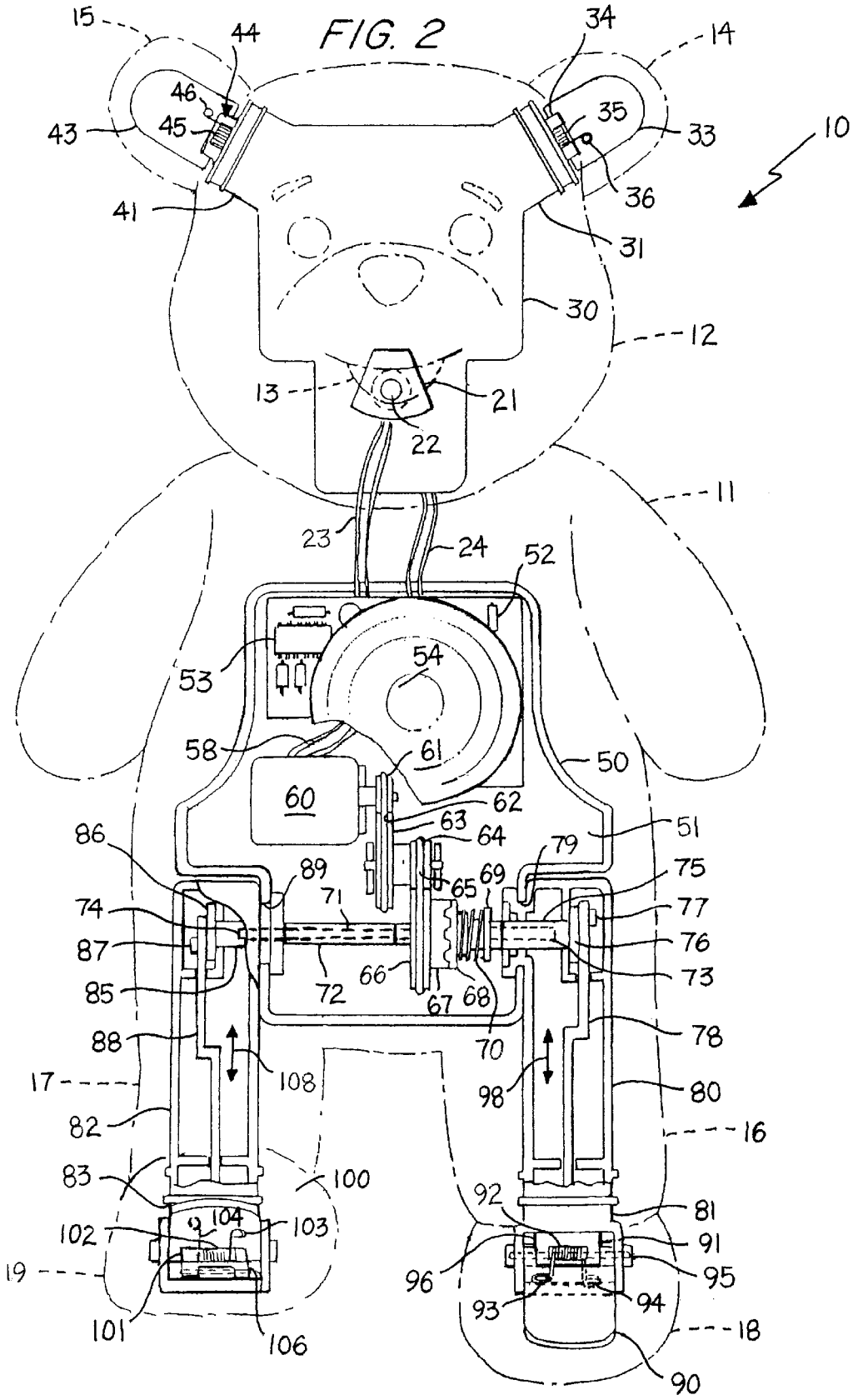
FIG. 2 sets forth a front section view of the present invention plush toy operative mechanism.

FIG. 2 sets forth a partially sectioned front view of the operative mechanism of plush toy 10. For purposes of aiding in the understanding and description of the operative mechanisms within plush toy 10, body 11, head 12, mouth 13, ears 14 and 15, legs 16 and 17 and toes 18 and 19 are shown in dashed-line fanthom representation. In the preferred fabrication of the present invention toy, the internal operative mechanisms are preferably formed for the most part by relatively low cost molded plastic components where possible. By way of overview, plush toy 10 includes an ear wiggling mechanism supported within a housing 30 which in turn is positioned within head 12 while toes 18 and 19 are manipulated by a mechanism supported largely within a lower housing 50. Lower housing 50 is supported for the most part within the interior torso portion of body 11.

More specifically, plush toy 10 includes an upper housing 30 having a switch 21 positioned behind mouth 13 which in turn supports a depressible button actuator 22. Upper housing 30 defines a pair of outwardly and upwardly extending ear extensions 31 and 41. Ear extension 31 supports a hinge 34 which in turn supports an ear paddle 33. Hinge 34 further includes a spring 35 which, in accordance with the present invention, includes end portions 36 and 37 (end 37 seen in FIG. 4). Of particular importance with respect to the present invention, end portions 36 and 37 of spring 35 are positioned on opposed sides of ear paddle 33.

Similarly, ear extension 41 supports a hinge 44 which in turn supports an ear paddle 43. A spring 45 having ends 46 and 47 (end 47 seen in FIG. 4) is received upon hinge 44. In similarity to spring 35 of ear paddle 33, ends 46 and 47 of spring 45 are positioned on opposite sides of ear paddle 43. By means set forth below in greater detail, ear paddles 33 and 43 are coupled to a respective pair of toggles 121 and 111 (seen in FIG. 4) which cause ear paddles 33 and 43 to oscillate or wiggle to move ears 14 and 15. The provision of hinges 34 and 44 together with springs 35 and 45 provides a protection for the operative mechanism within upper housing 30 against misuse as a child user, for example, applies excessive force to ears 14 and 15. In essence, springs 35 and 45 resiliently absorb such excessive force and prevent damage to the operative mechanism within upper housing 30.

Plush toy 10 further includes a lower housing 50 preferably formed of a molded plastic material or the like and defining an interior cavity 51. Lower housing 50 further defines a pair of leg apertures 79 and 89 within which a pair of hollow leg frames 80 and 82 are respectively secured in a pivotal attachment. Leg frames 80 and 82 are also preferably fabricated of a molded plastic material or the like.

Lower housing 50 further supports a conventional sound circuit 52 having a plurality of circuit components such as integrated circuit component 53 which operate in accordance with conventional fabrication techniques to energize a speaker 54. Speaker 54, when energized, produces audible sound in accordance with conventional speaker operation.

Lower housing 50 further includes an electric motor 60 operatively coupled to sound circuit 52 by a pair of wires 58. Motor 60 is operatively coupled to a pulley 61 which in turn is coupled to a pulley 63 by a flexible belt 62. Pulley 63 is joined to a pulley 64 which in turn is operatively coupled to a pulley 66 by a flexible belt 65. A pair of clutch members 67 and 68 are interposed between pulley 66 and a drive member 69. Drive member 69 captivates a clutch spring 70.

Leg frame 80 supports a rotatable sleeve 75 which in turn supports a wheel 76 having an eccentric or off-center post 77 extending therefrom. Sleeve 75 receives and engages end 73 of a square cross-section drive shaft 71. Shaft 71 extends through clutch member 69 and engages clutch member 69. While not seen in FIG. 2, it will be understood that pulley 66 and clutch member 67 do not engage square cross-sectioned shaft 71 but rather are freely rotatable thereon. Shaft 71 further supports a sleeve 72.

Similarly, leg frame 82 supports a sleeve 85 having end 74 of shaft 71 received therein and fitted in engagement therewith. Sleeve 85 further supports a wheel 86 having an off-center or eccentric post 87 extending therefrom.

Thus, the combined structure of sleeve 85, wheel 76 and clutch member 69 together with clutch member 68, sleeve 85 and wheel 86 are supported upon and engaged with shaft 71. Conversely, the combination of pulley 66 and clutch member 67 are freely rotatable with respect to shaft 71. As a result, power imparted to pulley 66 is coupled to shaft 71 solely through the clutch coupling between clutch members 67 and 68. The clutch mechanism thus formed is substantially conventional in fabrication.

Leg frame 80 further supports a toe support 81 having a hinge 91 formed therein. Hinge 91 is supported by a lever 96 and a toe paddle 90. A shaft 95 forms the rotational attachment for hinge 91 between lever 96 and toe paddle 90. Hinge 91 further includes a spring 92 having an end 93 on one side of toe paddle 90 and an end 94 on the opposite side of toe paddle 90. A link 78 is coupled to post 77 at its upper end and, by means set forth below in FIG. 3 in greater detail, is operatively coupled to lever 96.

In a similar fashion, leg frame 82 includes a toe support 83 upon which a toe paddle 100 is supported in the same fashion as shown for toe paddle 90. Thus, toe paddle 100 supports a hinge 101 having a spring 102 thereon. Hinge 101 is further coupled to a lever 106. Spring 102 includes an end 103 on one side of paddle 100 and an end 104 on the opposite side of paddle 100. In an identical fashion to the apparatus shown in FIG. 3 for link 78 and lever 96, a link 88 is pivotally coupled to lever 106 within toe support 83. The remaining end of link 88 is coupled to post 87 of wheel 86.

In operation as the child user presses an object such as cup 20 against mouth 13 in the manner shown in FIG. 1, button 22 is pressed inwardly and switch 21 is actuated. In response to the actuation of switch 21, sound circuit 52 produces audible sounds by energizing speaker 54. In addition, sound circuit 52 couples operative battery power from an internal battery power source within body 11 (not shown) to motor 60 via wires 58 and to the operative mechanism within upper housing 30 via wires 24. The energizing of motor 60 rotates pulley 61 which in turn rotates pulleys 62 and 64 via belt 62. Rotation of pulley 64 in turn rotates pulley 66 via belt 65. As pulley 66 is rotated, clutch member 67 and clutch member 68 are rotated. The engagement of clutch member 67 with clutch member 68 causes clutch member 69 to rotate. The rotation of clutch member 69 rotates shaft 71. As a result of the engagement between ends 73 and 74 of shaft 71 with sleeves 75 and 85 of leg frames 80 and 82 respectively, wheels 76 and 86 are rotated. The rotation of wheel 76 imparts a vertical oscillatory motion to link 78 due to the offset coupling of post 77. This vertical oscillatory motion is indicated by arrows 98. Similarly, the rotation of sleeve 85 rotates wheel 86 causing link 88 to be vertically oscillated in the directions indicated by arrows 108 due to the offset coupling of post 87. The operation of link 78 upon toe paddle 90 is set forth below in FIG. 3 in greater detail. Suffice it to note here that toe paddle 90 is oscillated about toe support 81 as link 78 is moved vertically in an oscillating motion. This in turn causes toe 18 to wiggle. Similarly, the oscillatory motion of link 88 in the directions indicated by arrows 108 causes toe paddle 100 to undergo a similar oscillating movement which in turn wiggles toe 19.

The operative mechanism coupled to ear paddles 33 and 43 within upper housing 30 is set forth below in FIGS. 4 and 5 in greater detail. However, suffice it to note here that the application of battery power to wires 24 energizes the operative mechanism within upper housing 30 causing ear paddles 33 and 43 to move back and forth which in turn wiggles ears 14 and 15.

Figure 3:
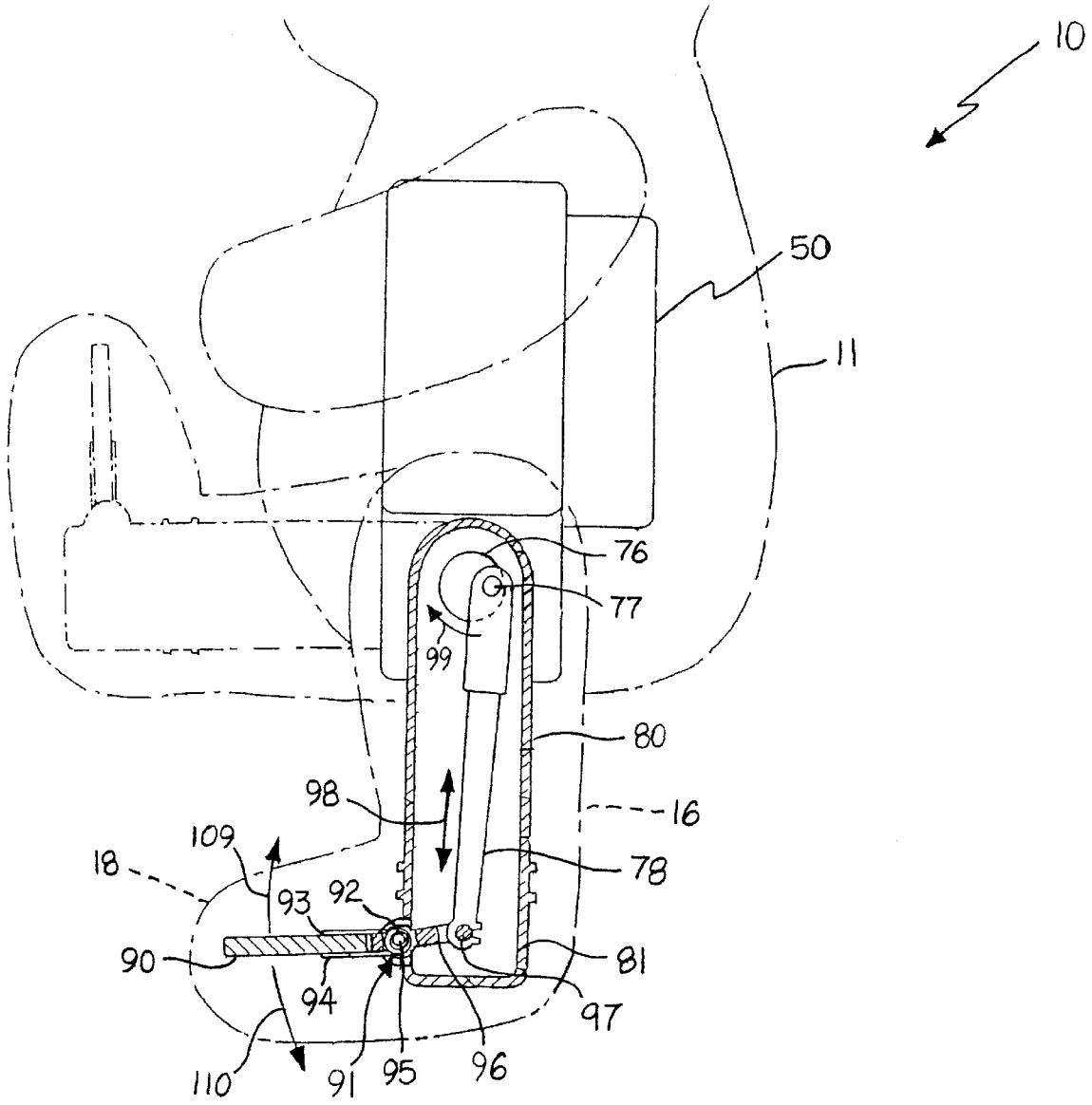
FIG. 3 sets forth a partial section side view of the present invention plush toy.

FIG. 3 sets forth a partial section view of the operative mechanism of leg frame 80 and toe paddle 90. For purposes of illustration, body 11 of toy 10 and leg 16 are shown in dashed-line representation.

As described above, leg frame 80 is rotatably supported upon housing 50 to facilitate moving leg 16 between the standing position shown in dashed-line representation and the forwardly extending seated position shown also in dashed-line representation. As described above, leg frame 80 supports a rotatable wheel 76 having an offset post 77. It will be recalled that wheel 76 is rotated in the direction indicated by arrow 99 in response to the operative power coupled from motor 60 in the manner shown in FIG. 2. Leg frame 80 supports a link 88 having its upper end coupled to post 77. Leg frame 80 further includes a toe support 81 within which a toe paddle 90 and a lever 96 are pivotally supported by a shaft 95. Lever 96 includes a shaft 97 coupled to the lower end of link 78. Lever 96 and toe paddle 90 are joined by a hinge 91. Hinge 91 further supports a spring 92 having opposed ends 93 and 94 on opposite sides of toe paddle 90. The combination of hinge 91 and spring 92 provides a flexing attachment between lever 96 and toe paddle 90. Thus, in the event excessive force is applied to toe 18 by the user, toe paddle 90 is able to pivot in the directions indicated by arrows 109 and 110 with respect to lever 96 as spring 92 flexes. In this manner, excessive force which would otherwise damage lever 96 or link 78 or the operative mechanism driving wheel 76 is absorbed by spring 92 preventing damage.

In operation as wheel 76 is rotated in the direction indicated by arrow 99, the offset position of post 77 causes link 78 to oscillate in the manner indicated by arrows 98. The oscillatory motion of link 78 in turn moves toe paddle 90 upwardly in the direction indicated by arrow 109 and downwardly in the direction indicated by arrow 110 in an oscillating fashion. As a result, toe 18 is caused to "wiggle".

In accordance with an important aspect of the present invention, it will be noted that the use of wheel 76 and post 77 to oscillate link 78 in the support structure shown in FIG. 2 places the rotation of leg frame 80 and wheel 76 along a common axis. This in turn allows the operative mechanism within leg frame 80 to function equally well regardless of the angular position of leg 16. Thus, in the seated legs forward extension position shown in dashed-line representation in FIG. 3, the above-described toe wiggling motion is obtained in the same manner as is provided in the leg position shown for standing posture.

Figure 4:
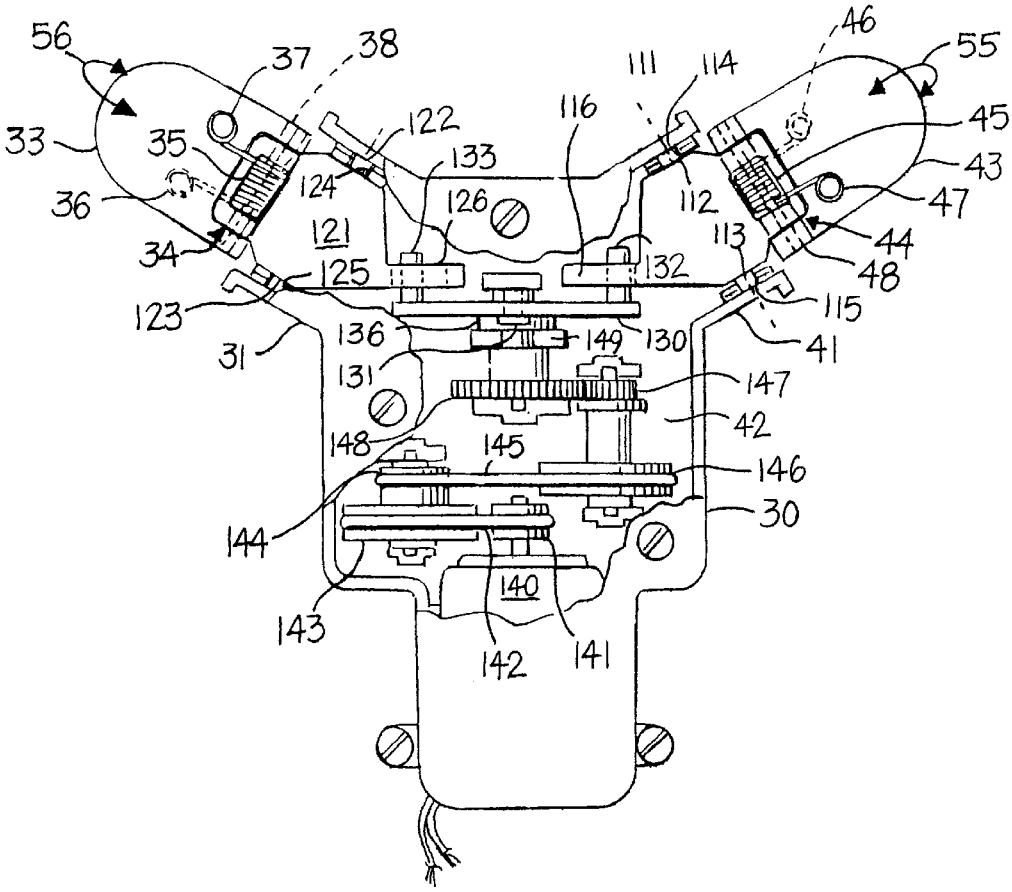
FIG. 4 sets forth a partial section view of the ear moving mechanism of the present invention plush toy.

FIG. 4 sets forth a partially sectioned rear view of upper housing 30 supporting ear paddles 33 and 43. Upper housing 30 is preferably formed of a molded plastic material or the like and defines an interior cavity 42 together with a pair of upwardly and outwardly angled ear extensions 31 and 41. Ear extension 31 defines a pair of notches 124 and 125. A toggle 121 includes a pair of posts 122 and 123 received within notches 124 and 125 respectively to pivotally secure toggle 121. Toggle 121 further includes a lobe 126 extending inwardly. An ear paddle 33 is joined to toggle 121 at a hinge 34. Hinge 34 includes a shaft 38 together with a spring 35. Spring 35 includes ends 36 and 37 positioned against opposite sides of ear paddle 33.

In a similar fabrication, ear extension 41 includes notches 114 and 115. A toggle 111 includes posts 112 and 113 received within notches 114 and 115 to pivotally support toggle 111 within ear extension 41. Toggle 111 includes a lobe 116 extending inwardly. An ear paddle 43 is joined to toggle 111 by a hinge 44. Hinge 44 includes a shaft 48 together with a spring 45. Spring 45 includes ends 46 and 47 positioned against opposite sides of ear paddle 43.

Upper housing 30 further supports a motor 140 having an output pulley 141 coupled to a pulley 143 by a belt 142. Pulley 143 is further coupled to a pulley 144 which in turn is coupled to a pulley 146 by a belt 145. Pulley 146 further supports a gear 147 which is coupled in engagement with a gear 148. Gear 148 in turn supports a shaft 149 which is joined to a wheel 136. As is better seen in FIG. 5, wheel 136 further includes an offset upwardly extending post 137.

A pivot member 130 is pivotally supported within upper housing 30 by a post 131. Pivot 130 further includes a pair of upwardly extending posts 132 and 133 which as is better seen in FIG. 5 are received within elongated slots formed in lobes 116 and 126 of toggles 111 and 121. The operation of motor 140 in moving ear paddles 33 and 43 in the manner indicated by arrows 55 and 56 is set forth below in connection with FIG. 5 in greater detail. However, suffice it to note here that motor 140 drives gear 147 through pulleys 141, 143, 144 and 146 using belts 142 and 145. Further, the rotation of gear 147 causes gear 148 to rotate which in turn rotates wheel 136. As wheel 136 rotates, pivot 130 is caused to oscillate which in turn imparts pivotal movement to lobes 116 and 126 to wiggle ear paddles 33 and 43.

Figure 5:
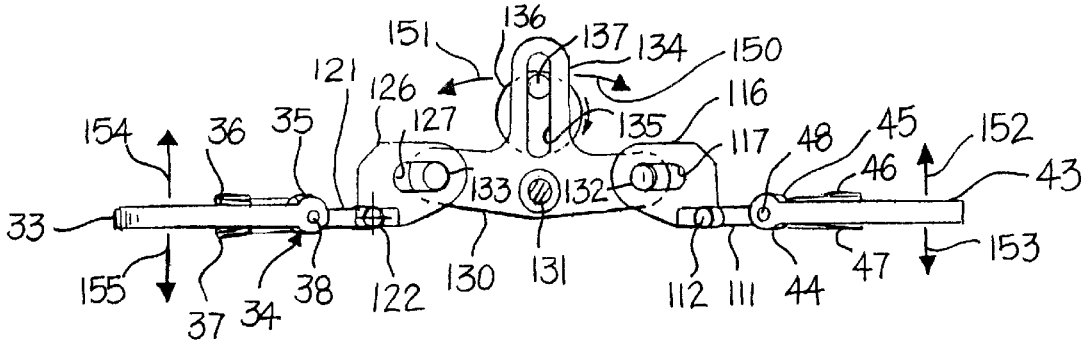
FIG. 5 sets forth a top view of the ear movement mechanism of the present invention toy.

FIG. 5 sets forth a partial top view of the ear moving mechanism operative within upper housing 30. As described above, a toggle 111 having a post 112 and a post 113 (seen in FIG. 4) is pivotally supported within ear extension 41 of upper housing 30 (also seen in FIG. 4). Toggle 111 is coupled to ear paddle 43 by a hinge 44. Hinge 44 includes a shaft 48 and a spring 45 having ends 46 and 47. Toggle 111 further includes a lobe 116 having a slot 117 formed therein.

Similarly, a toggle 121 is pivotally supported within ear extension 31 of upper housing 30 (seen in FIG. 4) by a pair of posts 122 and 123 (also seen in FIG. 4). Toggle 121 is joined to an ear paddle 33 by a hinge 34. Hinge 34 includes a shaft 38 and a spring 35 having ends 36 and 37.

A pivot 130 is pivotally supported within upper housing 30 (seen in FIG. 4) by a post 31 and includes a lobe 134 having a slot 135 formed therein. Slot 135 receives post 137 of wheel 136. Pivot 130 further supports a post 132 received within slot 117 of lobe 116 and a post 133 received within slot 127 of lobe 126.

In operation, as wheel 136 is rotated in the manner set forth above in FIG. 4 through the power of motor 140, the cooperation of offset post 137 and slot 135 causes lobe 134 to oscillate in the manner indicated by arrows 150 and 151. The pivoting oscillation of pivot 130 in turn pivots toggles 111 and 121 through the engagement of posts 132 and 133 with slots 117 and 127. As a result, as pivot 130 is oscillated back and forth, ear paddles 33 and 43 are pivotally moved in an oscillatory fashion as indicated by arrows 152 through 155.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A plush toy comprising:

a plush toy body having torso, head, mouth, nose, ears, arms, legs, feet and toes;

a pressure responsive switch in said nose;

a sound circuit in said torso;

a motor controller supported within said torso;

a pair of toe movement mechanisms in said legs, feet and toes;

a pair of ear movement mechanisms in said head and ears;

a first motor in said head coupled to said pair of ear movement mechanisms operative to wiggle said ears; and a second motor in said torso coupled to said pair of toe movement mechanisms operative to wiggle said toes, said motor controller being activated by said pressure responsive switch to activate said first and second motors and said sound circuit.

2. The plush toy set forth in claim 1 wherein said pair of toe movement mechanisms include:

a shaft extending between said legs having a wheel at each end within said legs;

a pair of links and eccentrics each coupled to one of said wheels, said links each passing downwardly through one of said legs and having a lower end;

a pair of toe paddles within each of said toes; and a pair of levers each coupled between one of said toe paddles and one of said lower ends.

3. The plush toy set forth in claim 2 wherein each of said levers is pivotally supported in each of said legs.

4. The plush toy set forth in claim 3 wherein each of said toe paddles includes a spring coupling said one toe paddle to said one lever.

5. The plush toy set forth in claim 1 wherein said pair of ear movement mechanisms include:

a pair of ear paddles within said ears;

a pair of toggles coupled to said ear paddles each having an inwardly extending end lobe;

a pivot coupled to said end lobes; and an eccentric drive coupled between said pivot and said first motor for oscillating said pivot and said end lobes.

6. The plush toy set forth in claim 5 wherein each of said ear paddles is pivotally supported in said head.

7. The plush toy set forth in claim 6 wherein each of said ear paddles includes a spring coupling to one of said toggles.

* * * * *